US005413341A

United States Patent [19]

Lieberman

[11] Patent Number: 5,413,341

[45] Date of Patent: May 9, 1995

[54] EQUIPMENT FOR, AND METHODS OF PLAYING, A PRIZE DRAWING GAME OF CHANCE

[76] Inventor: Leon D. Lieberman, 22210 Victory Blvd., Unit D-320, Woodland Hills, Calif. 91367

[21] Appl. No.: 84,578

[22] Filed: Jun. 29, 1993

Related U.S. Application Data

[63] Continuation of Ser. No. 791,025, Nov. 12, 1991, abandoned.

[51] Int. Cl.[6] ..... A63F 3/06

[52] U.S. Cl. ..... 273/138 R; 273/148 R; 283/30; 283/60.1; 283/903

[58] Field of Search ..... 273/139, 138 R, 138 A, 273/148 R; 283/60.1, 60.2, 53, 30, 903

[56] References Cited

U.S. PATENT DOCUMENTS 4,817,949 4/1989 Bachman et al. ..... 273/139

OTHER PUBLICATIONS

TV Guide, May 6, 1978, "Champion advertisement".

PR Newswire, May 3, 1988, Headline: AVAIL Increases ATM Usage With Sweepstakes.

*Primary Examiner*—Benjamin H. Layno

*Attorney, Agent, or Firm*—Lyon & Lyon

[57] ABSTRACT

Equipment and methods of entering and playing a prize drawing game of chance are disclosed, some of which do not require the participant to make a purchase in order to enter. The five ways of entering the game include the use of a written entry form which is printed, at intervals, along the length of a cash register tape, such that the entry forms are disseminated among customers when cash register receipts are generated by the use of the tape and are given to customers. Other ways of entering the game include: Filling out of a form which is included on a cash register tape received by the participant from or through one who received it after making a purchase, even though no purchase was made by the participant; filling out an entry form furnished by the sponsoring establishment and printed on a cash register receipt tape which is blank except for one or more such forms; filling out an entry form furnished at the sponsoring establishment but not printed on a cash register tape; and by filling out an entry form available as a coupon in a publication such as a newspaper or advertising flyer. Entry forms are randomly selected at each participating store from those entry forms collected at that store. Winners receive gift certificates redeemable for specified amounts or quantities of goods or services at the participating store indicated on the certificate.

20 Claims, 1 Drawing Sheet

EQUIPMENT FOR, AND METHODS OF PLAYING, A PRIZE DRAWING GAME OF CHANCE

This is a continuation of application Ser. No. 07/791,025, filed on Nov. 12, 1991, now abandoned.

BACKGROUND OF THE INVENTION

The field of the present invention is prize drawing games of chance and methods of entering and playing such games.

Games of chance, and prize drawings in particular, are well known in the art. However, prize drawings typically require the entrant to purchase, directly or indirectly, a chance to win the offered prize. For example, theaters use patrons' numbered ticket stubs as entry forms in prize drawings; but the theater patron is required, at least indirectly and incidentally, to pay money for a chance to win the drawing, since the patron has an opportunity to participate in such a drawing only because he has purchased a theater ticket bearing a numbered stub.

Such "purchase-required-for-entry" games of chance are legally problematical in many states, as many jurisdictions prohibit or heavily regulate games of chance in which something of value must be given by the participant in order to have a chance at winning the prize.

The use of cash register receipt tapes which bear printed discount coupons for in-store or other-store purchases of goods or services is also known in the art; but the coupons do not function as entry forms in a prize drawing game of chance. Instead, the bearer of the coupon presents it at a store where it is accepted as payment or part payment for the service, or for the item of merchandise, to which the coupon pertains. For this reason and others, the use of cash register receipt tapes as a vehicle for disseminating discount coupons differs markedly from the use of such tapes according to the present invention, as a vehicle for disseminating game-of-chance entry forms.

SUMMARY OF THE INVENTION

The present invention provides a means of promoting participation in a prize drawing game of chance, whereby printed entry forms are placed on the backs of the cash register receipt tapes which are routinely given to shoppers when they make purchases at the sponsoring establishment. Such tapes provide an efficient and well-targeted means, economical for the game sponsor and convenient for the entrant, of promoting a prize drawing game of chance among shoppers at a particular participating establishment.

In another aspect, the present invention provides a mechanism and alternative methods of entering the prize drawing game of chance, from among which methods the entrant may select, some of which methods do not require the entrant to make a purchase or give anything of value in return for a chance to win the game.

Other and further objects and advantages will appear hereinafter.

DETAILED DESCRIPTION OF THE PREFERRED EMBODIMENTS

Figure 1:
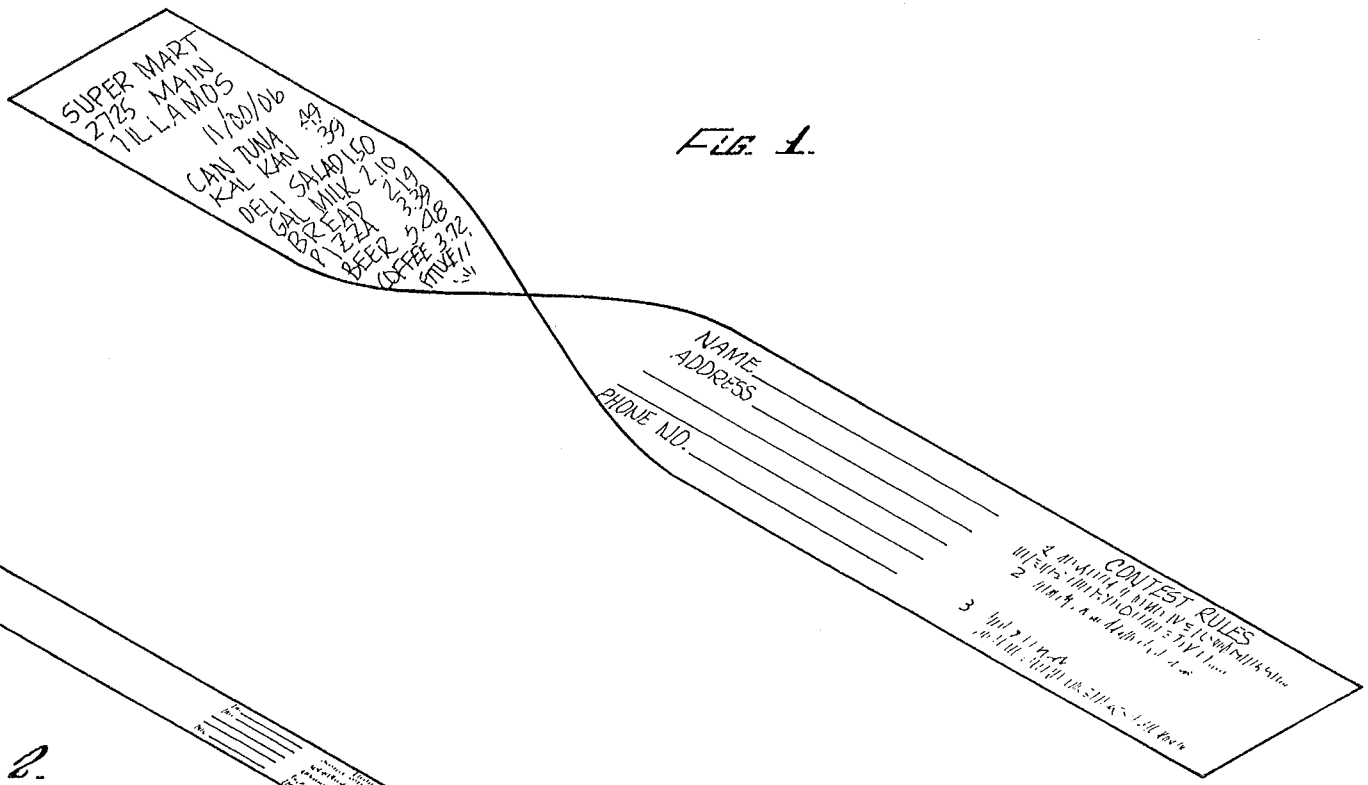
FIG. 1 is a pictorial view of a length of cash register receipt tape bearing on its back side a prize drawing game of chance entry form, and bearing on its front side conventional data recording the identities, prices, and quantities of items sold.

Written entry forms are made available to potential participants in five different, alternative ways, as follows: (1) An entrant may obtain an entry form by making a purchase at a participating establishment and receiving a cash register receipt tape which bears one or more written entry forms on the back side thereof, as shown in FIG. 1; or (2) an entrant may obtain an entry form without making any purchase by obtaining a cash register receipt tape entry form that someone else had received; or (3) an entrant may, without making a purchase, obtain from an authorized employee at a participating establishment an entry form which is printed on a piece of cash register receipt tape that is blank except for one or more such entry forms; or (4) an entrant may, without making any purchase, obtain from an authorized employee at a participating establishment an entry form which is printed on something other than a cash register receipt tape; or (5) an entrant may, without making any purchase, obtain an entry form which has been distributed as a clippable coupon in a newspaper or other advertising flyer. It will be appreciated that not all methods of entering the prize drawing game of chance require the entrant to have made a purchase at the sponsoring establishment, or elsewhere; and entrants enjoy the option to select a method of entering the prize drawing which does not require them to give anything of value in order to be admitted to participation in the drawing.

The entry form (FIGS. 1 and 2) provides spaces for participants to indicate appropriate identifying information (for example, name, address and telephone number). The entry form may also contain a written notice setting forth the rules of the prize drawing game of chance, including any entrant eligibility restrictions. Such restrictions may include requirements that entrants be residents of the state in which the prize drawing is conducted and/or that entrants be over a threshold age. For example, eligibility for a prize drawing in California might be limited to California residents over eighteen years of age. The rules may also define the frequencies and numbers of prize drawings and the values of the prizes. For example, the rules may provide that two hundred (200) winners will be chosen per participating establishment per month, and that the prize shall be a certificate redeemable for ten dollars ($10.00) worth of goods or services. Wide variation in the content of the rules is of course possible without departing from the spirit and scope of the invention. Instead of, or in addition to, printing the rules on the cash register tape, they may be disseminated by other means, including such conventional means as pamphlets, posters, handbills, and newspaper announcements.

Figure 2:
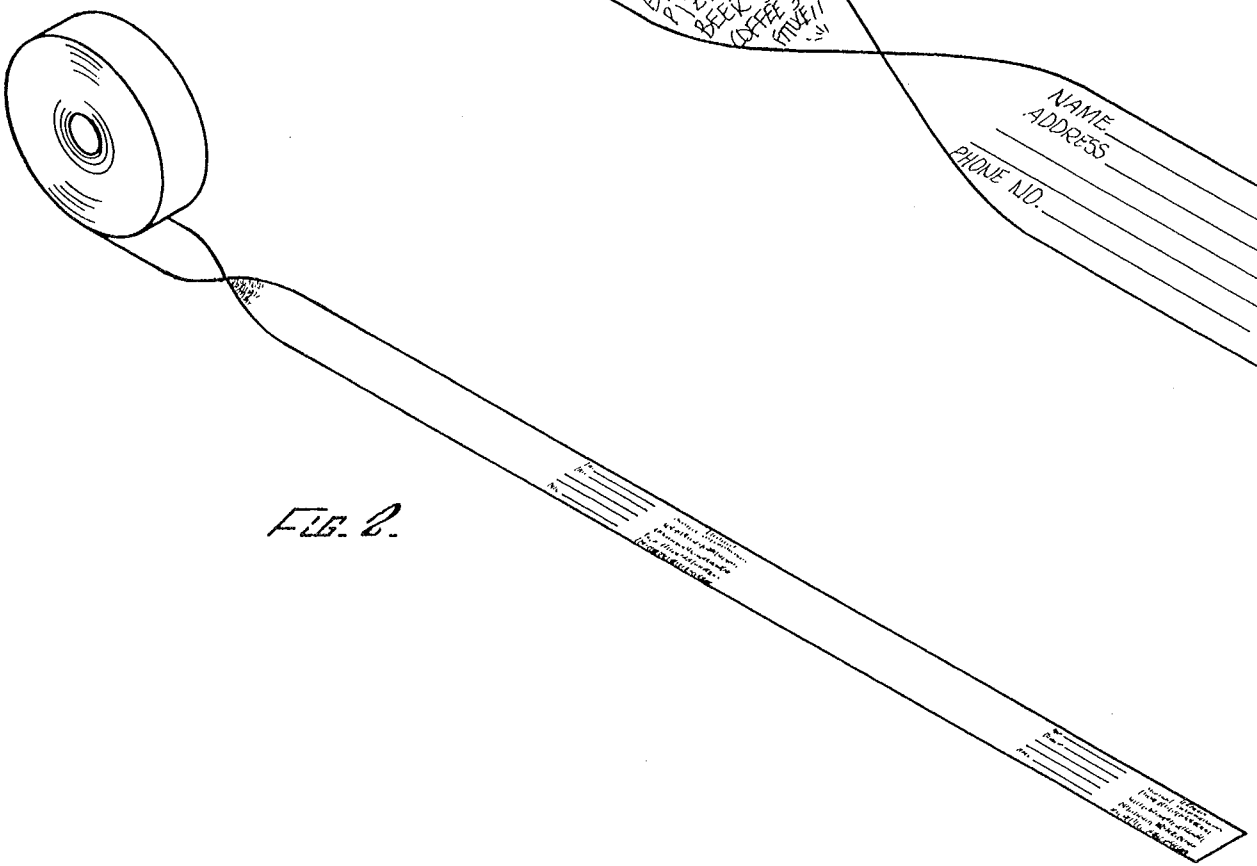
FIG. 2 is a pictorial view of a cash register receipt tape roll which bears tape which is blank on the front side but which bears on the back side a plurality of prize drawing game of chance entry forms spaced apart at intervals along the length of the tape.

Rolls of paper cash register receipt tape are supplied to the sponsoring establishment with prize drawing entry forms preprinted at intervals along the tape, as shown in FIG. 2, and these rolls are inserted into cash registers and used in the conventional way to generate cash register receipts which are given to customers. The receipts bear on the front side the conventional data concerning items sold, but bear on the back side the preprinted prize drawing entry forms. The preprinted entry forms may be spaced to occur repetitively at eighteen-inch intervals along the tape; but longer and shorter intervals are of course practical as well. Moreover, the entry forms need not be preprinted on the tapes before the tapes are inserted into the cash registers, but may instead be generated within the cash registers themselves through the use of printing means located therein. The entry forms provide spaces for entrants to indicate name, age, street address, city, state, zip code, telephone number, and state of residence.

Participating establishments provide designated receptacles for entrants to deposit completed entry forms. After a number of deposited entry forms have accumulated, a random sample of entry forms is selected by chance at each participating establishment from among those collected thereat. Each entrant whose entry form is selected is then notified (either by mail or by having his or her name posted at the participating store at which the winning entry form was deposited) that he or she has won a prize. Each prize winner receives a certificate (which may be non-transferrable) that is redeemable only at the establishment named on the certificate, which sets forth specified amounts or quantities of goods or services, of participating brands, that the winner may redeem by presenting the certificate. For example, if the participating establishment is a grocery store, the coupon may be redeemable for ten dollars ($10.00) worth of selected brands of groceries.

The funding of prizes is not supported by revenues generated through purchases only by those who have turned in entry forms. The prizes may be funded from general proceeds of the participating establishment, or by contributions from companies whose brands of goods or services are offered as eligible for redemption with the certificate awarded to winners of prize drawings, or by a combination of participating establishments' general revenues and contributions received from participating companies whose brands of goods or services are redeemable as prizes.

In another embodiment, the participating establishments are drugstores rather than grocery stores, and the prize certificate is redeemable for selected brands of merchandise other than groceries. Other variations are of course possible wherein, for example, the participating establishments are other than grocery or drugstores, and wherein the prize certificates are redeemable for services rather than goods.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A set of prize drawing entry forms which are made available to an entrant of a prize drawing game of chance, from which set the entrant can select one or more prize drawing entry forms for use in playing a prize drawing game of chance, said set comprising at least two of the following:

(a) a first prize drawing entry form comprising a cash register tape having a front side and a back side, said back side bearing thereon printed indicia including spaces for the insertion in writing of information identifying a prize drawing entrant and said front side being suitable for receiving data concerning items sold, the number of said first prize drawing entry forms received varying upon the length of said cash register tape, and wherein said first prize drawing entry form has been furnished to an entrant in the course of a transaction in which the entrant has purchased something of value;

(b) a second prize drawing entry form comprising a cash register tape having a front side and a back side, said back side bearing thereon printed indicia including spaces for the insertion in writing of information identifying a prize drawing entrant and said front side being suitable for receiving data concerning items sold, the number of said first prize drawing entry forms received varying upon the length of said cash register tape, and wherein said second prize drawing entry form has been obtained by an entrant where someone other than the entrant has purchased something of value;

(c) a third prize drawing entry form comprising a cash register tape having a front side and a back side, said back side bearing thereon printed indicia including spaces for the insertion in writing of information identifying a prize drawing entrant and said front side being suitable for receiving data concerning items sold, wherein said front side of said third prize drawing entry form is blank;

(d) a fourth prize drawing entry form comprising a coupon adapted to be removed from a publication; and (e) a fifth prize drawing entry form printed on a medium other than a cash register tape, wherein said fifth prize drawing entry form is obtainable from an employee of an establishment participating in said prize drawing game of chance.

2. The set of prize drawing entry forms of claim 1, wherein said printed indicia further include written rules pertaining to said prize drawing game of chance.

3. The set of prize drawing entry forms of claim 2, wherein said printed indicia are repeated at intervals along the length of said cash register tape of said first, second and third prize drawing entry forms.

4. The set of prize drawing entry forms of claim 2, wherein said printed indicia are preprinted.

5. The set of prize drawing entry forms of claim 2, wherein said printed indicia are placed on said cash register tape of said first, second and third prize drawing entry forms by printing means located within a cash register.

6. The set of prize drawing entry forms of claim 1, wherein said printed indicia are repeated at intervals along the length of said cash register tape of said first, second and third prize drawing entry forms.

7. The set of prize drawing entry forms of claim 1, wherein said printed indicia are preprinted.

8. The set of prize drawing entry forms of claim 1, wherein said printed indicia are placed on said cash register tape of said first, second and third prize drawing entry forms by printing means located within a cash register.

9. A method for the playing by an entrant of a prize drawing game of chance, which method comprises the following steps:

(a) selecting by the entrant of a source for the procurement of a written prize drawing entry form from among a group of alternative sources for said entry form, such alternative sources including at least two of the following and wherein only one of said at least two of the following is a cash register tape: (1) a cash register tape which bears the form in writing thereon and which has been furnished to the entrant in the course of a transaction in which the entrant has purchased something of value; and (2) a cash register tape which bears the form in writing thereon and which has been generated in the course of a transaction in which someone other than the entrant has purchased something of value; and (3) a cash register tape which bears the form in writing but is otherwise blank; and (4) a printed publication in which the form appears in writing as a coupon adapted to be removed and completed by the entrant; and (5) an authorized employee of an establishment which sponsors said prize drawing game of chance, which employee supplies to the entrant said form printed on a medium other than a cash register tape;

(b) filling out by the entrant of said prize drawing entry form by the insertion in writing thereon of information which identifies the entrant;

(c) depositing the filled out prize drawing entry form in a receptacle adapted to contain such forms;

(d) randomly selecting a prize drawing entry form from such receptacle; and (e) awarding a prize to an entrant based on said selection.

10. The method of claim 9, wherein said establishment which sponsors such prize drawing game of chance is a grocery store.

11. The method of claim 9, wherein said establishment which sponsors such prize drawing game of chance is a drugstore.

12. The method of claim 9, wherein said prize comprises a certificate redeemable for goods.

13. The method of claim 12, wherein the goods for which said certificate is redeemable comprise groceries.

14. The method of claim 9 wherein said prize comprises a certificate redeemable for services.

15. A set of prize drawing entry forms which are made available to an entrant of a prize drawing game of chance, from which set the entrant can select one or more prize drawing entry forms for use in playing a prize drawing game of chance, said set comprising:

(a) a first prize drawing entry form comprising a cash register tape having a front side and a back side, said back side bearing thereon printed indicia including spaces for the insertion in writing of information identifying a prize drawing entrant and said front side being suitable for receiving data concerning items sold, the number of said first prize drawing entry forms received varying upon the length of said cash register tape, and wherein said first prize drawing entry form has been furnished to an entrant in the course of a transaction in which the entrant has purchased something of value; and (b) a second prize drawing entry form comprising a coupon adapted to be removed from a publication.

16. A set of prize drawing entry forms which are made available to an entrant of a prize drawing game of chance, from which set the entrant can select one or more prize drawing entry forms for use in playing a prize drawing game of chance, said set comprising:

(a) a first prize drawing entry form comprising a cash register tape having a front side and a back side, said back side bearing thereon printed indicia including spaces for the insertion in writing of information identifying a prize drawing entrant and said front side being suitable for receiving data concerning items sold, the number of said first prize drawing entry forms received varying upon the length of said cash register tape, which said first prize drawing entry form has been furnished to an entrant in the course of a transaction in which the entrant has purchased something of value; and (b) a second prize drawing entry form printed on a medium other than a cash register tape which said second prize drawing entry form has been obtained from an employee of an establishment participating in said prize drawing game of chance.

17. A set of prize drawing entry forms which are made available to an entrant of a prize drawing game of chance, from which set the entrant can select one or more prize drawing entry forms for use in playing a prize drawing game of chance, said set comprising:

(a) a first prize drawing entry form comprising a cash register tape having a front side and a back side, said back side bearing thereon printed indicia including spaces for the insertion in writing of information identifying a prize drawing entrant and said front side being suitable for receiving data concerning items sold, the number of said first prize drawing entry forms received varying upon the length of said cash register tape, which said first prize drawing entry form has been obtained by an entrant where someone other than the entrant has purchased something of value; and (b) a second prize drawing entry form comprising a coupon adapted to be removed from a publication.

18. A set of prize drawing entry forms which are made available to an entrant of a prize drawing game of chance, from which set the entrant can select one or more prize drawing entry forms for use in playing a prize drawing game of chance, said set comprising:

(a) a first prize drawing entry form comprising a cash register tape having a front side and a back side, said back side bearing thereon printed indicia including spaces for the insertion in writing of information identifying a prize drawing entrant and said front side being suitable for receiving data concerning items sold, the number of said first prize drawing entry forms received varying upon the length of said cash register tape, which said second prize drawing entry form has been obtained by an entrant where someone other than the entrant has purchased something of value; and (b) a second prize drawing entry form printed on a medium other than a cash register tape, which said second prize drawing entry form has been obtained from an employee of an establishment participating in said prize drawing game of chance.

19. A set of prize drawing entry forms which are made available to an entrant of a prize drawing game of chance, from which set the entrant can select one or more prize drawing entry forms for use in playing a prize drawing game of chance, said set comprising:

(a) a first prize drawing entry form comprising a cash register tape having a front side and a back side, said back side bearing thereon printed indicia including spaces for the insertion in writing of information identifying a prize drawing entrant and said front side being suitable for receiving data concerning items sold, wherein said front side of said first prize drawing entry form is blank; and (b) a second prize drawing entry form comprising a coupon adapted to be removed from a publication.

20. A set of prize drawing entry forms which are made available to an entrant of a prize drawing game of chance, from which set the entrant can select one or more prize drawing entry forms for use in playing a prize drawing game of chance, said set comprising:

(a) a first prize drawing entry form comprising a cash register tape having a front side and a back side, said back side bearing thereon printed indicia including spaces for the insertion in writing of information identifying a prize drawing entrant and said front side being suitable for receiving data concerning items sold, wherein said front side of said first prize drawing entry form is blank; and (b) a second prize drawing entry form printed on a medium other than a cash register tape, which said second prize drawing entry form has been obtained from an employee of an establishment participating in said prize drawing game of chance.

* * * * *